US010647398B2

(12) United States Patent
Biebach

(10) Patent No.: US 10,647,398 B2
(45) Date of Patent: May 12, 2020

(54) BOAT ENGINE FOR PROPELLING A BOAT

(71) Applicant: Torqeedo GmbH, Gilching (DE)

(72) Inventor: Jens Biebach, Tutzing (DE)

(73) Assignee: Torqeedo GmbH, Gilching (DE)

( * ) Notice: Subject to any disclaimer, the term of this patent is extended or adjusted under 35 U.S.C. 154(b) by 0 days.

(21) Appl. No.: 16/140,198

(22) Filed: Sep. 24, 2018

(65) Prior Publication Data

US 2019/0092441 A1 Mar. 28, 2019

(30) Foreign Application Priority Data

Sep. 25, 2017 (DE) ..... 10 2017 122 151

(51) Int. Cl.

| | |
|---|---|
| ***B63H 21/22*** | (2006.01) |
| ***B63H 23/00*** | (2006.01) |
| ***B63H 20/10*** | (2006.01) |
| ***B63H 21/21*** | (2006.01) |
| *B63H 21/17* | (2006.01) |

(52) U.S. Cl.

CPC ..... *B63H 20/10* (2013.01); *B63H 21/21* (2013.01); *B63H 21/17* (2013.01); *B63H 2021/216* (2013.01)

(58) Field of Classification Search

CPC .... B63H 20/08; B63H 20/10; B63H 2020/08; B63H 2020/10; B63H 21/21; B63H 2021/21

USPC ..... 440/1, 6, 53, 61 T, 84–87

See application file for complete search history.

(56) References Cited

U.S. PATENT DOCUMENTS

| | | | | |
|---|---|---|---|---|
| 2,919,392 | A | 12/1959 | Smith | |
| 6,447,347 | B1 * | 9/2002 | Steinhauser | B63H 20/10 440/1 |
| 6,682,371 | B2 * | 1/2004 | Steinhauser | B63H 20/10 440/1 |
| 2002/0006753 | A1 * | 1/2002 | Steinhauser | B63H 20/10 440/1 |
| 2002/0045515 | A1 * | 4/2002 | Steinhauser | B63H 20/10 477/99 |
| 2004/0023568 | A1 | 2/2004 | Nagafusa | |
| 2009/0215334 | A1 | 8/2009 | Suzuki et al. | |
| 2010/0210155 | A1 | 8/2010 | Kinoshita | |

* cited by examiner

*Primary Examiner* — Daniel V Venne

(74) *Attorney, Agent, or Firm* — Crowell & Moring LLP

(57) ABSTRACT

An outboard engine for propelling a boat includes a propulsion unit with an electric motor, a propeller driven by means of the electric motor, a control unit for controlling the power of the electric motor, and a water detection means. The water detection means is adapted to detect whether the propeller is submersed in water. The power of the electric motor can be influenced via the control unit based on the detection.

12 Claims, 2 Drawing Sheets

BOAT ENGINE FOR PROPELLING A BOAT

CROSS REFERENCE TO RELATED APPLICATIONS

This application claims priority under 35 U.S.C. § 119 from German Patent Application No. 2017 122 151.4, filed Sep. 25, 2017, the entire disclosure of which is herein expressly incorporated by reference.

BACKGROUND AND SUMMARY OF THE INVENTION

The present invention relates to a boat engine for propelling a boat, and more particularly, to an outboard engine for propelling the boat.

Boat engines for propelling boats, which comprise a propulsion unit with an electric motor and a propeller powered by means of the electric motor, are known. Such boat engines are firstly known as on-board engines, which transfer the engine power of the electric motor to the propeller either via a fixed shaft system or a Z-drive in their conventional construction. Boat engines where the propulsion power is transferred to the propeller via a pod drive, for example, and also a pivotable pod drive, are also known.

As an alternative to this, so-called outboard engines are known, which are usually mounted on the stern of the boat to be propelled, and where a part of the outboard engine that lies above the waterline is connected with a part of the outboard engine that lies below the waterline via a shaft, on which the propeller is arranged.

Several construction types of outboard engines, which have a propulsion unit with an electric motor, are known, wherein there are, in particular, those outboard engines where the electric motor is arranged above the waterline, and the same is then connected to the propeller envisaged below the waterline via shafts and gears. In alternative embodiments, the electric motor is arranged in a housing lying below the waterline, and the electric motor acts on the propeller either directly or via a gear.

When electronically commutated electric motors are used and/or when electric motors where a speed regulation is realised electronically or by means of a series resistor are used, the corresponding power electronics for the electric motor can be above the waterline or below the waterline. A tightly spaced arrangement of the power electronics and the electric motor is often selected here. If the electric motor is, for example, located above the waterline, the power electronics can also be arranged above the waterline. If the electric motor is below the waterline, the power electronics can either be arranged above or also below the waterline.

Different construction types are also known for the power supply of outboard engines. It is, for example, known that the battery or the accumulator is fixed directly on the outboard engine, in a part of the outboard engine that lies above the waterline. Such outboard engines can be of a particularly compact construction, and form a self-contained unit, which is for example preferred for propelling smaller boats. The outboard engine will then require—in addition to the actual mechanical connection with the boat—no further installation or modification on the boat, and further installation space in the boat is not required.

In alternative embodiments, the battery or the accumulator is preferably located in the boat, and electricity is supplied to the part of the outboard engine located above the waterline via a corresponding supply cable.

All these boat engines, which comprise a propulsion unit with an electric motor, have in common that they usually have a rigid connection between the electric motor and the propeller. A neutral position, in which the combustion engine is uncoupled from the propeller by means of a gear, is, in particular, not normally envisaged—unlike with boat engines with a combustion engine. Combustion engines normally allow a possible starting of the engine only in a neutral position of the gear.

As a consequence, it is possible, with boat engines with a propulsion unit comprising an electric motor, that an accidental switch-on of the boat engine leads to an immediate rotation of the propeller, and therefore to a safety risk for persons nearby if the propeller is not in its actually envisaged condition, namely submersed in water.

This is the case in particular with outboard engines, and, most particularly, with portable outboard engines designed as a compact unit. An accidental switching on of the outboard engine can here also result in a "function control" of the outboard engine by the user, which is then operated by the user, or also during a service, in dry run outside of the water.

Even though operating instructions often include safety instructions in this regard and will point out that the boat engine must be mounted in its final position and operated only once the propeller is submersed, many users do not comply with these stipulations. A dry run operation of boat engines can lead to corresponding risks to persons nearby, to adjacent objects, as well as to the engine itself from the rotating propeller.

In addition it may result in an inadmissible heating up of the engine unit and/or the power electronics if the boat engine is not operated as instructed.

Based on this it is the object of the present invention to provide a boat engine that enables safer operation.

This object is solved by a boat engine for propelling a boat with the features described herein.

Accordingly a boat engine for propelling a boat, preferably an outboard engine for propelling a boat is suggested, comprising a propulsion unit with an electric motor and a propeller driven by means of the electric motor. According to the invention a water detection means is provided, which is adapted to detect whether the propeller is submersed in water.

The fact that the water detection means, which is adapted to detect whether the propeller is submersed in water or not, is provided means that it can be ascertained with the aid of the water detection means whether the boat engine is actually being operated in its intended regular position, namely in the position where the propeller is submersed, or not. If the boat engine is not operated in its intended position—and if the water detection means ascertains that the propeller is not submersed in water—corresponding measures can be carried out for preventing damage caused to the boat engine itself, the propeller, or nearby objects.

The power of the electric motor can for example be maintained at the power level at which the detection took place, or the power can be reduced or the electric motor can be stopped completely. In this way it can be ensured that a rotation of the propeller in a condition not submersed in water is possible only with limited or reduced power, or that such a rotation is completely prevented.

In this way risks to nearby persons, to surrounding objects and to the boat engine itself can be reduced or ruled out completely.

If power is for example kept constant or power is reduced in reaction to detecting that the propeller is not submersed in water, but the electric motor is not stopped completely, a function test can be carried out by the user prior to installing the boat engine or prior to pivoting the boat engine into its final stipulated position, in particular for boat engines designed as outboard engines, without the user having the feeling that the boat engine not yet installed could be defective.

The water detection means can contain a tilt sensor, with which the incline of the boat engine in relation to the horizontal and/or in relation to a component of the boat and/or the boat engine is determined. Such a tilt sensor can therefore, for example, determine the absolute position of the boat engine in space, for example by means of tilt sensors that measure the angle in relation to gravity or gravitation. Such a tilt sensor can however also be provided in the form of an angle sensor, which determines the angle of the boat engine in relation to a reference surface, for example in relation to a component of the boat engine such as for example a mounting plate or a mounting unit of the boat engine, or in relation to another component of the boat, for example the stern or the transom of the boat. If this results in the angle or the incline not complying with the predetermined angle or the predetermined incline that equals a correct mounting position, the water detection will signal that the propeller is not positioned in its regular submersed position.

The tilt sensor can also be designed as a positioning module or a satellite navigation system such as for example GPS, GLONASS, Galileo or Beidou installed in the boat engine, by means of which orientation is possible in addition to positioning.

The water detection means can also comprise a water sensor for detecting a submersion in water, wherein the water sensor is preferably provided in the vicinity of the propeller shaft of the boat engine. The water sensor can for example be arranged in a housing of the propulsion unit in the vicinity of the propeller shaft outlet. The water sensor can for example measure water wetting or water pressure. If the water sensor finds that it is not wet or that a stipulated hydrostatic pressure does not exist, the water sensor will correspondingly determine that the propeller is not correctly submersed in water.

In a further embodiment, the water detection means comprises a rev counter for determining the rotation speed of the electric motor and a power meter for determining the power of the electric motor (or torque meter for determining the torque of the electric motor), and the water detection means can be adapted for detecting whether the propeller is submersed in water during operation of the electric motor on the basis of the power characteristics (or the torque) of the electric motor in relation to the rotation speed of the electric motor. This makes use of the knowledge that the motor needs to compensate only no-load losses when the propeller is operated in air, and not in the submersed position. If the propeller is however submersed in water the absorbed and output power of the electric motor is substantially cubic as the rotation speed increases. An evaluation of the motor power compared to the rotation speed of the electric motor can consequently determine whether the propeller is submersed in water and whether a corresponding approximately cubic power curve related to a rotation speed curve occurs, or whether the absorbed or output power is quasi linear and only serves for compensating occurring no-load losses.

In this way it can be ascertained upon accidentally switching on the boat engine and when starting the propeller whether the propeller is submersed or not. This can preferably be realised by means of the components already provided in the boat engine in any case. Rotation speed measurement is normally provided for a boat engine with an electric motor, with which the rotation speed of the electric motor can then be set and also regulated or monitored, as the running modes for the boat engine stipulated by the respective user are normally converted into rotation speed stipulations. A rotation speed signal is normally also already provided and can be used for evaluating the water sensor.

A power meter can be used to measure power. Normally electric drives do however already include means, for example for measuring the torque, rotation speed, DC link current or the battery current and/or the DC link voltage or the battery voltage.

The power meter is preferably adapted accordingly to determine power on the basis of the rotation speed measured, the measured torque and/or on the basis of the DC link voltage and the DC link current and/or on the basis of the battery current and the battery voltage. Power can therefore be determined in the presence of the respective signals, for example as a product of torque and rotation speed, or as a product of DC link voltage and DC link current, or as a product of battery voltage and battery current. Torque can also be used on its own as a measure of power and can for example also be used on its own for determining operating points. As the corresponding measuring devices, and therefore the corresponding signals, are already provided, further construction measures can be omitted and the water sensor can revert to measurement signals that already exist, so that a cost-effective and very reliable solution for monitoring the submersion of the propeller in water during operation results here.

In an alternative or additional consideration only the torque is used. With a substantially constant and increasing propeller rotation speed, it can be assumed here that the propeller rotates in air, and only the bearing friction must be overcome. If the torque however increases quadratically as the propeller rotation speed rises, the propeller is submersed in water.

In this way a water detection that is independent from the pitching or rolling of the boat and from different installation positions or installation angles of the respective boat engine, as is essentially the case with an incline determination, can correspondingly also be carried out.

In one preferred further development a control unit for controlling the power of the electric motor is provided, wherein the control unit communicates with the water detection, and the control unit can maintain and/or limit and/or reduce the power and/or rotation speed and/or torque of the electric motor or stop the electric motor upon detection of a propeller that is not submersed in water. In this way a direct and safe limiting of the power and/or the rotation speed and/or the torque of the boat engine or a stopping of the boat engine results to prevent damage, accidents and injuries caused by an incorrectly arranged or installed boat engine.

In at least one embodiment, the control unit is adapted for allowing a renewed increase in power and/or the rotation speed and/or the torque or a renewed starting of the electric motor only after the limiting and/or maintaining and/or reducing of power and/or the rotation speed and/or the torque and/or after stopping the electric motor, if a running mode adjuster for stipulating a running mode has been set to a lower running mode or to a zero position. In this way it can be prevented that a sudden start or a sudden increase in power, the rotation speed or the torque occurs when the propeller is submersed in water and an uncontrolled action of the boat engine results from the same.

This is of particular importance also when the power and/or the rotation speed and/or the torque of the electric motor is reduced or switched off when a boat capsizes and until it has righted itself again. In such a case, and especially if persons have gone overboard, an automatic renewed switching on of the electric motor or an increase in power, rotation speed and torque can be dangerous for persons still in the water or can make it impossible for such persons still in the water to reach the boat upon renewed contact of the propeller with water. In an extreme case the boat would carry on travelling driverless and would leave persons still in the water behind.

In one further development a short-term reduction in the power of the electric motor during a brief emersion of the propeller can be realised, for example, if the boat is lifted by waves in such a way that the propeller is briefly surrounded by air or, because a boat that is hydro-foiling jumps across the waves. In this way an uncontrolled speeding up of the propeller upon emersion from the water can be avoided and the entire battery power used can be reduced in this way and wear will be less.

In order to not bring about an undesired reduction in power, torque or rotation speed, or even a switching off of the boat engine during normal operation of said boat engine when the propeller is briefly lifted out of the water due to boat movements the water detection, and preferably also the interference with the torque, the rotation speed or the power of the electric motor connected with the same during normal operation can be switched off. Such switching off can for example be triggered in that the water detection detects that the propeller is submersed when the electric motor is first switched on or started up—for example also within a predetermined period of time. If this is the case, the water detection will then be switched off.

A reaction time can also be defined in order to avoid disadvantageous effects, upon expiry of which a maintaining or reducing of power, of torque or of the rotation speed or a switching off of the electric motor is carried out.

Reducing the rotation speed or the power or the torque, or switching off the electric motor can also be realised by means of a predetermined control curve, for example a flat ramp, as shown, for example, in FIG. 3, so that no abrupt reduction in rotation speed and/or power and/or torque will occur.

Other features and advantages of the present invention will become apparent from the following more detailed description, taken in conjunction with the accompanying drawings, which illustrate, by way of example, the principles of the presently described embodiments.

DETAILED DESCRIPTION OF THE DRAWINGS

Figure 1:
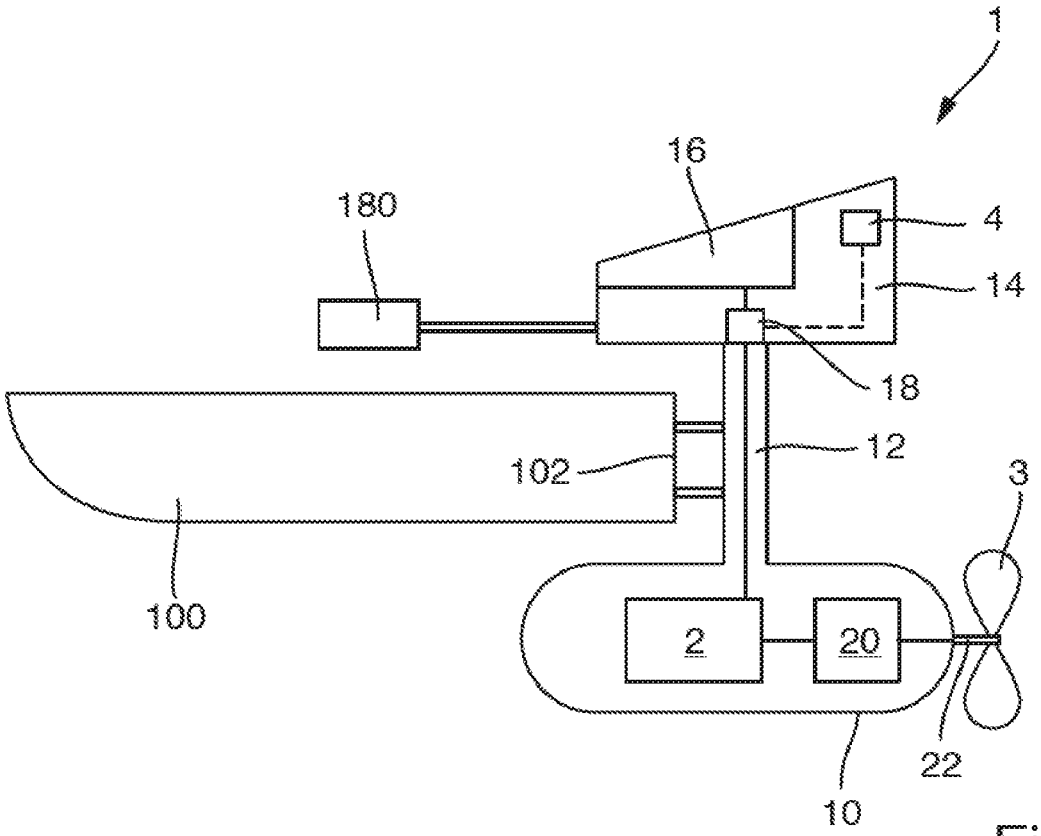
FIG. 1 is a schematic illustration of a boat with a boat engine for propelling the boat.

The above described drawing figures illustrate the disclosed invention in at least one of its preferred, best mode embodiment, which is further defined in detail in the following description. Those having ordinary skill in the art may be able to make alterations and modifications to what is described herein without departing from its spirit and scope. While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspects of the invention to any embodiment illustrated. Therefore, it should be understood that what is illustrated is set forth only for the purposes of example and should not be taken as a limitation on the scope of the disclosed invention. Identical, similar or identically acting elements are generally identified with corresponding reference signs in the various figures, and a repeated description of these elements is omitted in order to avoid redundancies.

FIG. 1 shows a schematic illustration of a boat engine 1 for propelling a boat 100, also shown schematically. The boat engine 1 is here shown in the form of an outboard engine mechanically mounted on the transom 102 of the boat 100 by means of a corresponding tiltable connection.

The boat engine 1 according to this embodiment in form of an outboard engine comprises a part 14 lying above the waterline, which is connected with a housing part 10 lying below the waterline via a shaft 12. An electric motor 2 is located in the housing part 10 located below the waterline, amongst other things, and acts on a propeller 3 via a gear 20. When the electric motor 2 is supplied with power it turns the propeller 3 and generates a corresponding propulsion in the water, which then acts on the boat 100 via the mechanical connection. Such a construction of an outboard engine is known in principle.

Electric power for supplying the electric motor 2 is stored in a battery 16 in the embodiment example shown, which is arranged in the upper housing part 14 of the outboard engine. The power supply or the control of the electric motor 2 is realised by means of a control unit 18, with which the power provided by the battery 16 is prepared accordingly and transmitted to the electric motor 2 in line with the running mode stipulated by the respective user. The control unit 18 can therefore also comprise the power electronics for the electric motor 2.

The running mode can be stipulated by the respective user via a running mode adjuster 180, which is provided on the helm of the boat engine 1 in the embodiment example shown. The running mode adjuster 180 enables an operation of the electric motor 2 with forward thrust or backward thrust, and different power settings can be stipulated as running modes—for example 20%, 50%, 80% and 100% of the available power. In other embodiments a stipulation with more power settings or a substantially continuous power setting can also be realised. It is for example also possible here to envisage a differentiated stipulation of power settings for applying the forward thrust, but only a small number of power settings—for example just 50% and 80%—for the backward thrust.

Alternatively or in addition to the above mentioned power settings a stipulation and control/regulation of speed settings and/or torque settings and/or rotation speed settings to be stipulated can be realised by means of the running mode adjuster.

Irrespective of the design of the possible power settings a corresponding desired running mode can be selected by the user by means of the running mode adjuster 180 during normal operation of the boat engine 1 when the boat engine 1 is mounted correctly and the propeller 3 is submersed in water, and the electric motor 2 is then powered accordingly, so that the desired thrust is applied to the boat 100.

The boat engine 1 shown in the embodiment example has a very compact construction, where the actual electric motor 2 including the propeller 3 as well as the power supply in the form of a battery 16 are contained in the outboard engine. Such a boat engine 1 can therefore be disconnected from the boat as a whole and there is no need to locate electric or mechanical components inside the boat 100. The only construction stipulation for the boat 100 is the provision of a mechanical connection on the transom 102 of the boat 100, so that the boat engine 1 can be mounted on the transom 102.

In alternative embodiment examples the battery can for example also be located in the interior of the boat 100, and a power supply to the boat engine 1 will then for example be realised by means of a cable between the battery located on the boat 100 and the part 14 of the boat engine 1 located above the waterline.

In further alternatives the electric motor as well as the battery can be positioned inside the boat 100.

In order to now prevent that the propeller 3 causes damage to persons, objects or the boat engine 1 itself because it is not being operated in its envisaged position, for example because the propeller 3 is being operated without being submersed in water, the water detection 4 is provided, by means of which it can be detected whether the propeller 3 is submersed in water during operation. If the propeller 3 is in water it will be assumed that the boat engine 1 is located in its stipulated position and in its regular position.

The water detection 4 can detect by means of various components whether the boat engine 1 is in the stipulated position and the propeller 3 is submersed in water.

Figure 2:
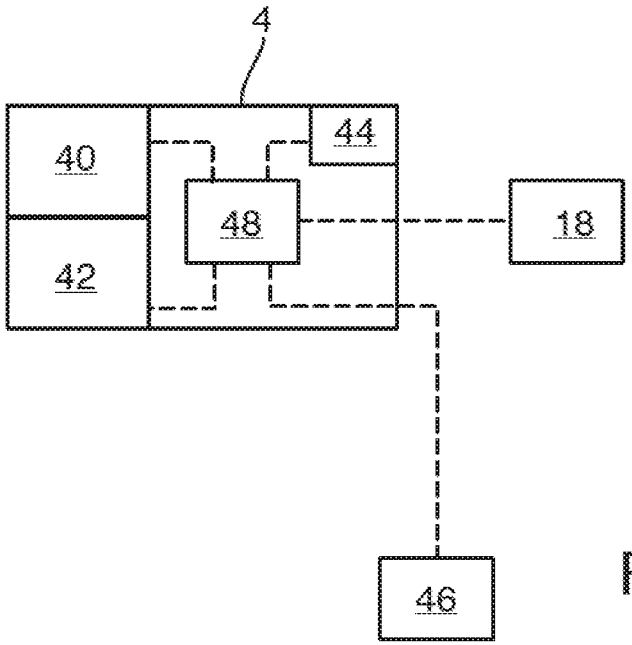
FIG. 2 is a schematic illustration of a water detection.
Figure 3:
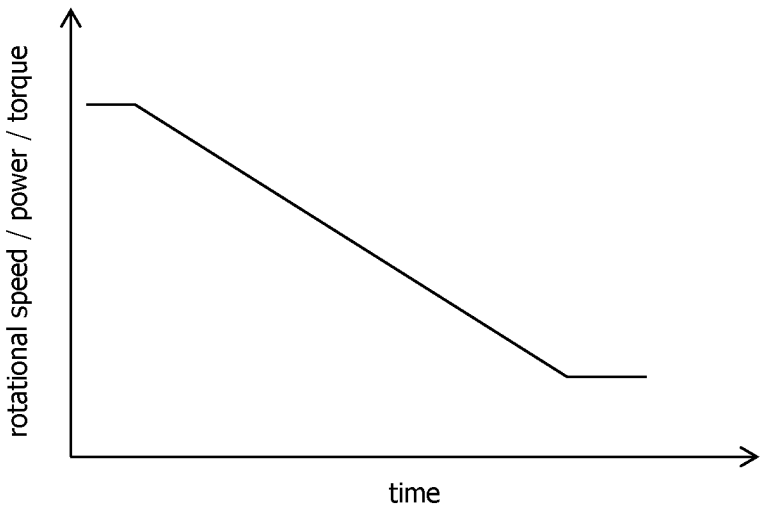
FIG. 3 is an illustration of an exemplary control curve.

The water detection 4 is shown highly schematically in FIG. 2.

A detection of whether the propeller 3 is submersed in water can for example be carried out in that a rotation speed of the propeller 3 or the electric motor 2 is determined by means of a rev counter 40 and the electric power absorbed by the electric motor 2 is simultaneously determined with the aid of a power meter (or torque meter) 42.

It can be determined on the basis of the characteristics of the electric power determined with the power meter 42 in relation to the rotation speed of the electric motor 2, determined with the rev counter 40, and with the aid of an evaluation means 48 whether the propeller 3 is submersed in water or not. This is based on the knowledge that the electric power absorbed by the electric motor 2 when the propeller 3 is submersed in water increases substantially cubically with the rotation speed, whilst a rotation of the propeller 3 outside of the water, and thus in air, will merely require a compensation of no-load losses upon first approximation. The electric power absorbed correspondingly increases cubically when the propeller 3 is submersed, whilst such a strong power increase will not be seen when the same rotates in air and a more linear development will be observed.

Correspondingly it will become obvious on the basis of the calculated rotation speed values and the electric power with the aid of the evaluation means 48 whether the propeller 3 is submersed in water during the operation of the electric motor 2 of the boat engine 1 or not.

In an alternative or additional consideration only the torque is used. It can be assumed in view of a substantially constant torque with increasing propeller rotation speed here that the propeller 3 is rotating in air and only the bearing friction must be overcome. If the rotation speed does however increase quadratically as the propeller rotation speed increases the propeller 3 is submersed in water.

In addition or alternatively the water detection 4 can also comprise a tilt sensor 44, with which the angle of the boat engine 1 is measured either in relation to the vertical—and thus in relation to the direction of gravity—and/or in relation to other components of the boat 100, for example in relation to the transom 102 of the boat or a mounting means of the boat engine 1. It is therefore possible to determine either an absolute positioning of the boat engine 1 compared to its surroundings, or a relative positioning of the boat engine 1 compared to other components of the boat 100.

If the boat engine 1 is not arranged in the actual envisaged position, namely for example in such a way that the propeller 3 is not aligned with a drive shaft that is substantially aligned at a horizontal level, but with a drive shaft that is substantially aligned at a vertical level, it is assumed that the boat engine 1, and in particular the propeller 3, is not arranged in its regular position and can therefore not be submersed in water either.

This means that it can therefore be recognised by means of the tilt sensor 44 whether the propeller 3 is submersed in water or not. It can thus be ascertained at least during the calculation of positions of the boat engine 1 that can clearly not lead to an envisaged submersion of the propeller 3 in water, that the propeller 3 is not submersed in water.

This is for example the case if the tilt sensor 44 finds that the driveshaft 22 of the propeller 3 is aligned substantially vertically. Such an alignment of the driveshaft 22 for example exists with an outboard engine during its transport, when the outboard engine is for example transported in the boot of a car or lies on a jetty or on a beach prior to mounting on the boat. In such a case it can be safely assumed that the propeller 3 is not submersed in water and a rotating of the propeller 3 should thus be prevented.

The tilt sensor 44 can also be incorporated into a positioning module or a satellite navigation system installed in any case, such as for example GPS, GLONASS, Galileo or Beidou, with which orientation is possible in addition to positioning.

In a further alternative or in addition to the same a water sensor 46 can also be provided, which is for example arranged in the area of the lower housing part 10, for example in the area of the outlet of the propeller shaft 22, and which accordingly detects whether it is wetted with water or whether it is submersed in water, or whether it is dry. In this way it can be safely ascertained whether the water sensor 46, and therefore the propeller 3, is submersed in water or not.

The three mentioned types of determination of whether the propeller 3 is located in a position submersed in water and/or whether it is positioned correctly can either be used on their own, or they can be incorporated into the evaluation means 48.

If the evaluation means 48 of the water detection 4 finds that the propeller 3 is not submersed in water, or that it is improbable that the boat engine 1 is being operated in the provided correct position, the water detection 4 will signal this to the control unit 18 accordingly.

The relevant measures can then be implemented in the control unit 18 for preventing damage to the propeller 3, the boat engine 1, to surrounding objects or to persons. The control unit 18 can for example maintain the power of the electric motor 2 at the time when the corresponding signal is received by the water detection 4 upon receipt of the signal from said water detection 4 to indicate that a correct operation of the boat engine 1 does not exist. The power of the boat engine 1 can then correspondingly no longer be increased further.

The control unit 18 can further reduce the power of the electric motor 2 or stop the electric motor 2 completely in a further design in response to the corresponding signal of the water detection 4.

In this way it can be ensured that the propeller 3 can run dry only with limited or reduced power and/or at a limited or reduced rotation speed and/or at a limited or reduced torque, or that such a dry rotation is substantially suppressed. In this way the boat engine 1 as well as the propeller 3, and also persons and surrounding objects, can be protected.

In this way the acoustic emissions of the boat engine 1 can also be reduced during dry running. This is for example also of importance when function testing is carried out in the dry by the user.

In one further development the control unit 18 can be designed in such a way that a renewed increase in power and/or the rotation speed of the electric motor 2 upon receipt of the signal from the water detection 4, and thus a detection that the propeller 3 is not submersed in water, can be implemented only if the running mode stipulated by means of the running mode adjuster 180 is reduced or the running mode adjuster 180 is brought into a zero position. A renewed starting of the electric motor 2 of the boat engine 1 is also preferably allowed only after a reduction of the stipulated running mode or after the running mode adjuster 180 has been brought into the zero position.

This design of the control unit 18 enables the prevention of the boat engine 1 unexpectedly applying thrust to the boat 100 without this actually being desired by the operator. This is in particular of importance when the propeller 3 for example comes into contact with water again following a capsizing of the boat and a subsequent righting of the boat. Such a case could lead to fatal accidents if the engine suddenly starts up again at full power and the boat moves away from persons in the water with full power in a worst-case scenario, or if the same are injured by the rotating propeller 3.

The water detection 4 can be integrated into the control unit 18.

In a preferred design the water detection 4 and the control unit 18 comprise the same CPU which is adapted for carrying out the functions of the control unit 18 as well as the functions of the water detection 4. A simple construction can be realised in this way, where a corresponding programming can realise the functions of the control unit 18 and the water detection 4. This is of particular advantage when data as to whether the water detection 4 for determining whether the propeller 3 is submersed in water or not is already present in the control unit 18.

This is for example the case when the current rotation speed of the electric motor 2 and the current power absorption or power output of the electric motor 2 for control or regulation purposes are already known in the control unit 18. The water detection 4 can calculate from this data alone whether the propeller 3 is submersed in water or not. This can be calculated in particular as to whether a substantially cubic relationship exists between the increase in rotation speed and the power of the propeller 3 or the electric motor 2, or a substantially linear relationship. If a cubic relationship exists the propeller 3 acts as it does in water. If a linear relationship exists the propeller 3 acts as it does in air.

If only the torque is considered it can for example be assumed with a substantially constant torque and increasing propeller rotation speed that the propeller 3 rotates in air and only bearing friction needs to be overcome. If the torque however increases quadratically with increasing propeller rotation speed, the propeller 3 is probably submersed in water.

Power determination can for example be based on determining the measured rotation speed and the measured torque and/or on the basis of the DC link voltage and the DC link current and/or on the basis of battery current and battery voltage, and a power meter 42 can be provided in the water detection 4, which is adapted for determining current power on the basis of the measured rotation speed and the measured torque and/or on the basis of the DC link voltage and the DC link current and/or on the basis of battery current and battery voltage. This data can also already be provided in the control unit 18 for controlling the electric motor 2, so that existing data can be used efficiently in particular during an integration of the water detection 4 with the control unit 18. The recording of further will in particular be unnecessary then, as already existing data can be used.

The objects, advantages and features described in detail above are considered novel over the prior art of record and are considered critical to the operation of at least one embodiment of the present invention and to the achievement of at least one objective of the present invention. The words used in this specification to describe these objects, advantages and features are to be understood not only in the sense of their commonly defined meanings, but also to include any special definition with regard to structure, material or acts that would be understood by one of ordinary skilled in the art to apply in the context of the entire disclosure.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C. An exception to this definition will occur only when a combination of elements, functions, steps or acts are in some way inherently mutually exclusive.

Reference throughout this document to "one embodiment", "certain embodiments", "an embodiment" or similar term means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner on one or more embodiments without limitation.

The definitions of the words or drawing elements described herein are also meant to include not only the combination of elements which are literally set forth, but all equivalent structures, materials or acts for performing substantially the same function in substantially the same way to obtain substantially the same result. In this sense, it is therefore contemplated that an equivalent substitution of two or more elements may be made for any one of the elements described and its various embodiments or that a single element may be substituted for two or more elements in a claim without departing from the scope of the present invention.

Moreover, it will be understood that, with respect to various aspects of the described embodiments that one of ordinary skill in the art would attribute to the implicit operation of one or more computing elements, such elements generally include hardware and/or software/firmware, including but not limited to: processors, memories, input/output interfaces, operating systems and network interfaces, configured to effectuate the functionalities described herein. When implemented in software, such elements or aspects of the invention are essentially the code segments to perform the necessary tasks. The code segments can be stored in a processor readable medium or transmitted by a computer data signal. The "processor readable medium" may include any medium that can store information. Examples of the processor readable medium include an electronic circuit, a semiconductor memory device, a ROM, a flash memory or other non-volatile memory, a floppy diskette, a CD-ROM, an optical disk, a hard disk, etc.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted in conjunction with the appended claims.

LIST OF REFERENCE NUMBERS

1 Boat engine
100 Boat
102 Transom
10 Lower housing part
12 Shaft
14 Upper housing part
16 Battery
18 Control unit
2 Electric motor
20 Gear
22 Propeller shaft
3 Propeller
4 Water detection
40 Rev counter
42 Power meter/Torque meter
44 Tilt sensor
46 Water sensor
48 Evaluation means
180 Running mode adjuster

What is claimed is:

1. An outboard engine for propelling a boat, comprising:
a propulsion unit having an electric motor and a propeller driven by the electric motor; and
a water detection means configured to detect whether the propeller is submersed in water, wherein the water detection means comprises one or more of:
a rev counter that determines a rotational speed of the electric motor,
a power meter that determines a power of the electric motor, and
a torque meter that determines a torque of the electric motor,
wherein the water detection means is further configured to detect whether the propeller is submersed in water during operation of the electric motor on the basis of characteristics of the power and/or torque of the electric motor in relation to the rotational speed of the electric motor; and
a control unit configured to control the power and/or the rotational speed and/or the torque of the electric motor, wherein the control unit communicates with the water detection means and the control unit maintains and/or limits and/or reduces the power and/or the rotational speed of the electric motor and/or the torque of the electric motor, or stops the electric motor upon detecting that the propeller is not submersed in water.

2. An The outboard engine of claim 1, wherein the water detection means comprises a tilt sensor, with which an incline of the engine in relation to a horizontal and/or in relation to a component of the boat and/or the engine is determined.

3. An The outboard engine of 1, wherein the water detection means comprises a water sensor provided in a vicinity of a propeller shaft of the engine.

4. An The outboard engine of claim 1, wherein the power meter is adapted to detect the power based on the determined rotational speed and the determined torque and/or based on a DC link voltage and a DC link current and/or on the basis of a battery current and a battery voltage.

5. An The outboard engine of claim 1, wherein the control unit is adapted to enable a renewed increase in power and/or the rotational speed and/or the torque or a starting of the electric motor following the limiting and/or maintaining and/or reducing of the power and/or the rotational speed and/or the torque and/or following the stopping of the electric motor only if a running mode adjuster for stipulating a running mode has been brought to a lower running mode or to a zero position.

6. An The outboard engine of claim 1, wherein the water detection means is adapted to be switched off during regular operation when the propeller is submersed.

7. An The outboard engine of claim 6, wherein a limiting and/or maintaining and/or reducing of the power and/or the rotational speed and/or the torque and/or a stopping of the electric motor will not take place during regular operation on the basis of the water detection when the water detection is switched off.

8. An The outboard engine of claim 6, wherein the water detection means is adapted to be, following expiry of a predetermined time period upon determining that the propeller is submersed in water, switched off and/or a reduction of the rotational speed and/or the power and/or the torque across a predetermined control curve, is implemented.

9. An The outboard engine of claim 7, wherein the water detection means is adapted to be, following expiry of a predetermined time period upon determining that the propeller is submersed in water, switched off and/or a reduction of the rotational speed and/or the power and/or the torque across a predetermined control curve, is implemented.

10. The outboard engine of claim 1, wherein the water detection means is adapted to be switched off when the water detection means detects that the propeller is submersed in water when the electric motor is first switched on or started.

11. The outboard engine of claim 8, wherein the predetermined control curve across which the rotational speed and/or the power and/or the torque are reduced includes a flat ramp.

12. The outboard engine of claim 9, wherein the predetermined control curve across which the rotational speed and/or the power and/or the torque are reduced includes a flat ramp.

* * * * *